US010130855B2

(12) United States Patent
Stokke

(10) Patent No.: US 10,130,855 B2
(45) Date of Patent: Nov. 20, 2018

(54) LOW AND BACK CROWN MASS FOR A GOLF CLUB HEAD

(71) Applicant: KARSTEN MANUFACTURING CORPORATION, Phoenix, AZ (US)

(72) Inventor: Ryan M. Stokke, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/147,698

(22) Filed: May 5, 2016

(65) Prior Publication Data

US 2017/0021239 A1 Jan. 26, 2017

Related U.S. Application Data

(60) Provisional application No. 62/157,306, filed on May 5, 2015.

(51) Int. Cl.
*A63B 53/04* (2015.01)
*A63B 53/06* (2015.01)
*A63B 53/08* (2015.01)

(52) U.S. Cl.
CPC ..... *A63B 53/06* (2013.01); *A63B 53/0466* (2013.01); *A63B 53/08* (2013.01); *A63B 2053/0408* (2013.01); *A63B 2053/0437* (2013.01); *A63B 2053/0491* (2013.01)

(58) Field of Classification Search
CPC ..... A63B 53/06; A63B 53/0466; A63B 53/08; A63B 2053/0408; A63B 2053/0491; A63B 2053/0437
USPC ..... 473/324–350, 287–292, 256
See application file for complete search history.

(56) References Cited

U.S. PATENT DOCUMENTS 5,272,802 A * 12/1993 Stites, III ..... A63B 53/04 29/527.2
5,306,450 A * 4/1994 Okumoto ..... B29C 44/18 264/259
5,316,298 A * 5/1994 Hutin ..... A63B 53/04 273/DIG. 23
5,720,674 A 2/1998 Galy
5,938,540 A * 8/1999 Lu ..... A63B 53/04 473/288
5,947,840 A * 9/1999 Ryan ..... A63B 53/04 473/335
6,527,650 B2 3/2003 Reyes
6,860,818 B2 3/2005 Mahaffey
6,890,267 B2 5/2005 Mahaffey
7,147,573 B2 * 12/2006 DiMarco ..... A63B 53/0466 473/324
7,163,468 B2 1/2007 Gibbs
7,410,428 B1 8/2008 Dawson
7,658,687 B2 * 2/2010 Hirano ..... A63B 53/0466 473/345
8,033,930 B2 10/2011 Tavares
8,043,167 B2 * 10/2011 Boyd ..... A63B 53/0466 473/334

(Continued)

*Primary Examiner* — Sebastiano Passaniti

(57) ABSTRACT

A golf club head includes a body having a crown defining a perimeter of the club head, a sole opposite the crown, a toe end opposite a heel end, a back end, and a hosel, the body further including a club face, an exterior side, an interior side, a head center of gravity, and a weight member positioned on one of the exterior side or the interior side of the crown.

19 Claims, 9 Drawing Sheets

(56) References Cited

U.S. PATENT DOCUMENTS

| | | | | |
|---|---|---|---|---|
| 8,206,243 | B2 * | 6/2012 | Stites | A63B 53/0466 473/334 |
| 8,221,260 | B2 * | 7/2012 | Stites | A63B 53/0466 473/324 |
| 8,371,957 | B2 | 2/2013 | Schweigert | |
| 8,506,421 | B2 * | 8/2013 | Stites | A63B 53/0466 473/335 |
| 8,657,702 | B2 * | 2/2014 | Boyd | A63B 53/0466 473/334 |
| 8,696,491 | B1 | 4/2014 | Myers | |
| 8,753,224 | B1 * | 6/2014 | Kim | A63B 53/0466 473/327 |
| 2002/0055391 | A1 * | 5/2002 | Teramoto | A63B 53/00 473/291 |
| 2007/0129167 | A1 * | 6/2007 | Matsunaga | A63B 53/0466 473/345 |
| 2007/0265108 | A1 * | 11/2007 | Lin | A63B 53/0466 473/334 |
| 2010/0016098 | A1 * | 1/2010 | Tavares | A63B 53/0466 473/334 |

* cited by examiner

| | Club Head Weight(g) | Discretionary Weight(g) | % Discretionary Weight | Golf Club Length(inches) |
|---|---|---|---|---|
| Driver | 200-210 | 20-60 | 15-35 | >43 |
| Fairway Wood | 210-240 | 45-85 | 20-40 | 40-44 |
| Hybrid | 220-280 | 70-130 | 25-55 | 35-42 |

| Club Type | Club # | Length (inches) | SWT | Headweight (grams) | Discretionary Mass(grams) | Percent Discretionary Mass |
|---|---|---|---|---|---|---|
| **Driver** Volume: ≥400cc Lofts: 0-20 deg Club Length: ≥43" USGA Heel Toe > Front Back: Heel-Toe≥4" | 1 | 48 | D3 | 202.5 | ≥39.5 | ≥19.5 |
| | | 47 | D3 | 204 | ≥41.0 | ≥20.1 |
| | | 46 | D3 | 205.5 | ≥42.5 | ≥20.7 |
| | | 45.75 | D3 | 206 | ≥43.0 | ≥20.9 |
| | | 45 | D3 | 207 | ≥44.0 | ≥21.3 |
| | | 44 | D3 | 208.5 | ≥45.5 | ≥21.8 |
| **Fairway** Volume: 115cc-300cc Lofts: 10-40 deg Club Length: 38-44" | 3 | 43 | D1 | 219 | ≥59.0 | ≥26.9 |
| | 5 | 42.5 | D1 | 223 | ≥63.0 | ≥28.3 |
| | 7 | 42 | D1 | 227 | ≥67.0 | ≥29.5 |
| | 9 | 41.5 | D1 | 232 | ≥72.0 | ≥31.0 |
| **Hybrid** Volume: 80cc-140cc Lofts: 15-60 deg Club Length:35"-42" | 2 | 40.75 | D1 | 230 | ≥90.0 | ≥39.1 |
| | 3 | 40.25 | D1 | 235 | ≥95.0 | ≥40.4 |
| | 4 | 39.75 | D1 | 240 | ≥100.0 | ≥41.7 |
| | 5 | 39.25 | D1 | 245 | ≥105.0 | ≥42.9 |
| | 6 | 38.75 | D1 | 250 | ≥110.0 | ≥44.0 |
| **Irons** Lofts: 15-60 deg Club Length:35"-42" | 4 | 38.875 | D0 | 239 | ≥24.0 | ≥10.0 |
| | 5 | 38.25 | D0 | 247 | ≥29.0 | ≥11.7 |
| | 6 | 37.625 | D0 | 255.5 | ≥33.5 | ≥13.1 |
| | 7 | 37 | D0 | 264 | ≥39.0 | ≥14.8 |
| | 8 | 36.5 | D0 | 272 | ≥40.0 | ≥14.7 |
| | 9 | 36 | D0 | 280 | ≥40.0 | ≥14.3 |
| | W | 35.5 | D2 | 290 | ≥40.0 | ≥13.8 |
| | U | 35.5 | D2 | 290 | ≥41.0 | ≥14.1 |
| | S | 35.25 | D4 | 297 | ≥41.0 | ≥13.8 |
| | L | 35 | D6 | 306 | ≥43.0 | ≥14.1 |

FIG. 8

LOW AND BACK CROWN MASS FOR A GOLF CLUB HEAD

CROSS REFERENCE TO RELATED APPLICATION

This claims the benefit of U.S. Provisional Patent Application No. 62/157,306, filed on May 5, 2015, which is incorporated fully herein by reference.

FIELD OF THE INVENTION

The present disclosure relates to a golf club, and more specifically to a mass of discretionary weight on a crown of a golf club head that increases a moment of inertia by positioning the weight an increased distance away from a center of gravity.

BACKGROUND

Golf clubs take various forms, for example a wood, a hybrid, an iron, a wedge, or a putter, and these clubs generally differ in head shape and design (e.g., the difference between a wood and an iron), club head material(s), shaft material(s), club length, and club loft.

Woods and hybrids generally have a longer shaft and lower loft than irons and wedges. Thus, a golf ball that is struck with a wood or a hybrid generally travels a greater distance than a golf ball struck with an iron or a wedge. While a longer shaft and a lower loft provide increased golf ball travel distance, this combination also results in less forgiveness. The longer shaft requires a golfer to stand farther away from the golf ball at address. This leads to greater difficulty during the golf swing to return the club head squarely to impact the golf ball. A golf club that is slightly open or slightly closed at impact results in reduced accuracy as the golf ball is not launched on the desired target line. Further, the higher swing speeds from the longer length shaft can lead to greater difficulty in making consistent contact with the center or "sweet spot" of the golf club face. Off-center contact can lead to imparting increased side spin on the golf ball. At reduced lofts of woods and hybrids, less back spin is imparted on the golf ball at impact, further exacerbating imparted side spin and leading to undesirable hooks or slices, which further decrease accuracy.

To improve directional forgiveness, golf club manufacturers have made efforts to increase the moment of inertia of a golf club at impact. The moment of inertia (or "MOI") is a measure of a body's resistance to angular acceleration, or twisting. The higher the MOI of a golf club head, the more the golf club head resists twisting at impact, improving golf ball accuracy, especially on off-center contact (or mishits). In addition, the increased stability of a higher MOI golf club head results in a golf ball losing less ball speed on off-center contact due to reduced energy loss associated with reduced twisting. A higher MOI of a golf club head further increases consistency in spin rate and launch angle of a golf ball on off-center contact.

While woods and hybrids have a variety of known designs, there is a need for enhancing directional forgiveness (e.g., a reduction in side-to-side variation) to improve accuracy, especially on off-center hits (e.g., contact of the golf ball with a location on the golf club face other than the sweet spot).

BRIEF DESCRIPTION OF THE DRAWINGS

FIG. 8 is another table providing data associated with exemplary club heads of the club head in FIG. 1 including drivers, fairway woods, hybrids, and irons.

DETAILED DESCRIPTION

Figure 1:
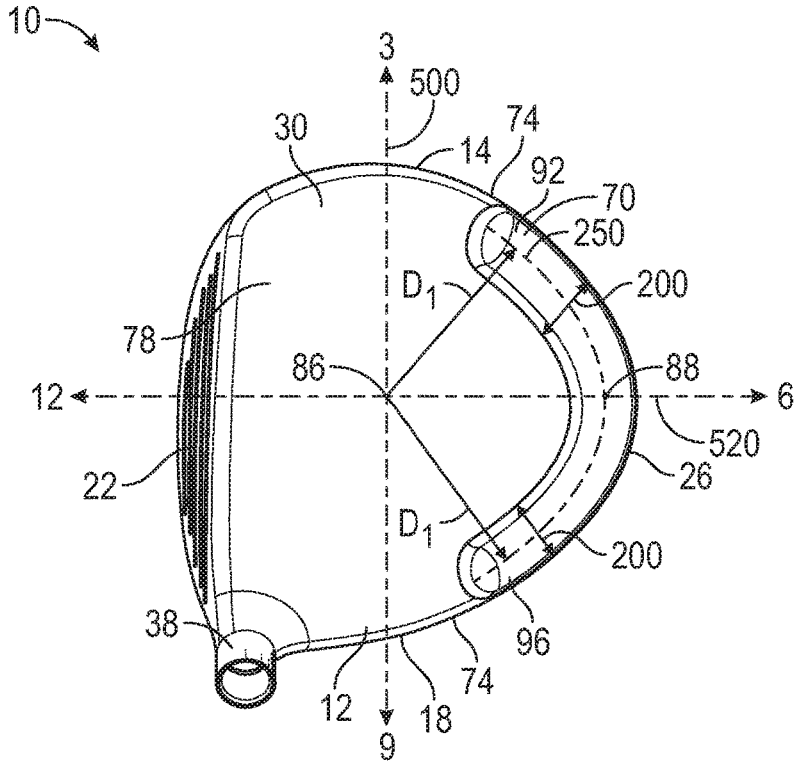
FIG. 1 is a top view of an embodiment of a golf club head having a weight member.

One embodiment includes a club head design that increases and/or maximizes golf club head moment of inertia (MOI) by positioning discretionary weight farther away from the head center of gravity than other known golf club heads. Discretionary weight, or a portion thereof, is positioned on the exterior side of the club head crown in the form of a weight member that extends about a portion of a perimeter defined by the crown at the back of the club head. By positioning the weight member on an exterior surface of the club head crown, the distance between the center of gravity and the discretionary weight is increased over club heads that position discretionary weight on an interior surface or the exterior surface of the sole of the club head. Therefore, the MOI of the club head is increased to provide greater forgiveness and consistency in direction, trajectory, and distance.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

Discretionary weight, as described herein, refers to a portion of the total weight of the club head that can be moved to optimize performance without impacting the structural integrity of the club head.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

For ease of discussion and understanding, and for purposes of description only, the following detailed description illustrates a golf club head 10 as a fairway wood. It should be appreciated that the fairway wood is provided for purposes of illustration of the discretionary weight positioning on an exterior surface of the club head 10 that increases MOI and directional forgiveness, as disclosed herein. The disclosed discretionary weight positioning may be used on any desired wood, hybrid, or other club that has discretionary weight that may be moved to increase MOI. For example, the club head 10 may include, but is not limited to, a driver, a fairway wood, or a hybrid.

FIGS. 1-4 illustrate an embodiment of the golf club head 10 for use with a golf club. Referring generally to FIGS. 1-4, the club head 10 includes a body 12, the body 12 having a toe or toe end 14 opposite a heel or heel end 18, a crown 30 opposite a sole 34, a back or rear or back end 26, and a hosel axis 36 extending through the center of a hosel 38. The club head 10 further includes a face or club face or strike face 22 opposite the back end 26, an exterior side 78, and an interior side 82, the club face 22 having a geometric center.

Figure 4:
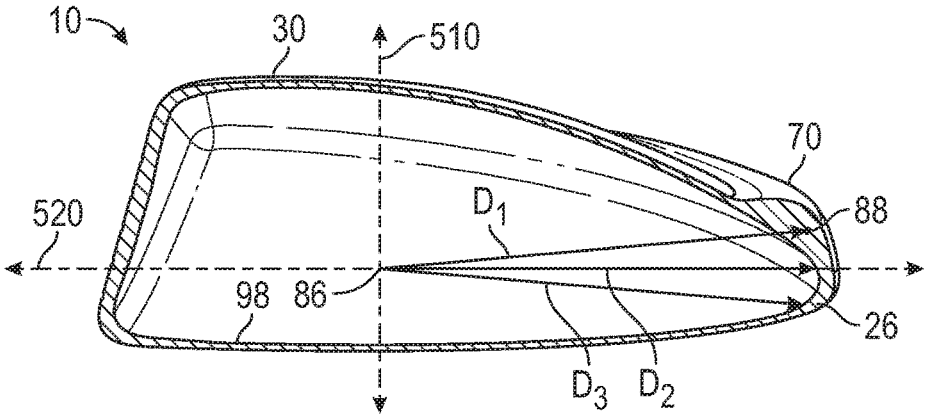
FIG. 4 is another side view of the club head in FIG. 1.

Referring to FIGS. 1 and 4, the crown 30 defines a crown surface curvature or profile 84 when viewed from a side view (FIG. 4) and a perimeter 74 when viewed from a top view (FIG. 1). The club head 10 further includes a head center of gravity 86, and a weight member or plurality of weight members 70 positioned adjacent to the crown 30, the weight member 70 having a weight member center of gravity 88.

Referring to FIGS. 1 and 4, the head center of gravity 86 defines an origin of a coordinate system including an x-axis 500, a y-axis 510, and a z-axis 520. The x-axis extends 500 through the head center of gravity 86 from the toe end 14 to the heel end 18, the y-axis 510 extends through the head center of gravity 86 from the crown 30 to the sole 34, and the z-axis 520 extends through the head center of gravity 86 from the club face 12 to the back 26. For additional guidance, the x-axis 500 and z-axis 520 are arranged to coincide with numbers on an analog clock, with the z-axis 520 extending between 12 o'clock ("12" through the club face 22) and 6 o'clock ("6" through the back 26), and the x-axis 500 extending between 3 o'clock ("3" through the toe end 14) and 9 o'clock ("9" through the heel end 18).

In the illustrated embodiment, referring to FIGS. 1-4, the weight member 70 includes a first end 92 positioned near the toe 14 and a second end 96 positioned near the heel 18. In the illustrated embodiments of FIGS. 1-4, the weight member 70 is positioned on the exterior of the crown and about a portion of a perimeter defined by the crown. The weight member 70 has a width 200 and a projection height 204. The projection height 204 may vary along the width 200 of the weight member 70, defining a projection height profile 208.

In the illustrated embodiment, referring to FIGS. 1-4, the weight member 70 has an elongated shape wherein the projection height profile 208 of the weight member 70 is substantially constant from the first end 92 to the second end 96. Specifically, the projection height 204 of the weight member 70 varies along the width 200 defining an arcuate or curved shape. The curved projection height profile 208 has a maximum projection height 212 positioned approximately centrally along the width 200 of the weight member 70, wherein the maximum projection height 212 is approximately constant from the first end 92 to the second end 96 of the weight member 70.

In other embodiments, the weight member 70 may be any suitable shape, including, but not limited to a polygon or a shape with at least one curved surface. For example, the weight member 70 may be round, triangular, elliptical, trapezoidal, or any other shape. Further, the projection height profile 208 of the weight member may have any profile and may be constant or may vary along the width 200 of the weight member 70 in any capacity. For example, the projection height profile 208 may be linear, quadratic, exponential, or a combination of the above described projection height profiles 208 such that the maximum projection height 212 may be positioned anywhere along the width 200 of the weight member 70. Further still, the projection height profile 208 and the maximum projection height 212 may vary from the first end 92 to the second end 96 of the weight member 70.

In some embodiments, the width 200 may range from 0.05-2.5 inches (1.27-63.5 mm). For example, the width 200 may be between 0.25 inches (6.35 mm) and 1.5 inches (38.1 mm), or the width 200 may be greater than approximately 0.25 inches (6.35 mm), greater than approximately 0.5 inches (12.7 mm), greater than approximately 0.66 inches (16.8 mm), greater than approximately 0.75 inches (19.0 mm), or greater than approximately 1.0 inches (25.4 mm). For further example, the width 200 can be approximately 0.3 inches (7.6 mm), 0.4 inches (10.2 mm), 0.5 inches (12.7 mm), 0.6 inches (15.2 mm), 0.7 inches (17.8 mm), 0.8 inches (20.3 mm), 0.9 inches (22.9 mm), or 1.0 inches (25.4 mm).

In some embodiments, the maximum projection height 212 may range from 0.05 inches (1.27 mm) to 0.45 inches (11.43 mm). For example, the maximum projection height 212 may be between 0.10 inches (2.54 mm) and 0.30 inches (7.62 mm), or the maximum projection height may be approximately 0.10 inches (2.54 mm), 0.15 inches (3.81 mm), 0.175 inches (4.45 mm), 0.20 inches (5.08 mm), 0.225 inches (5.72 mm), 0.25 inches (6.35 mm), 0.275 inches (6.99 mm), 0.30 inches (7.62 mm), or 0.35 inches (8.89 mm).

Figure 5:
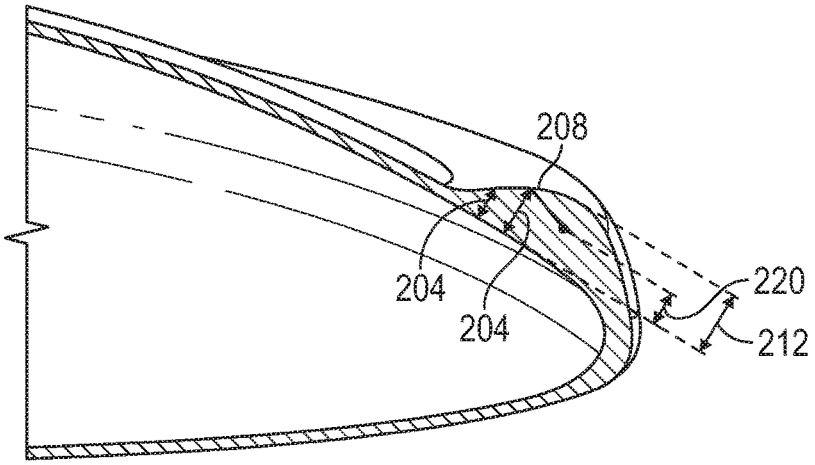
FIG. 5 is an enlarged side view of the club head in FIG. 1.

In the illustrated embodiment, shown in FIG. 5, the maximum projection height 212 is greater than the maximum projection height of known golf club heads having weight members positioned on the sole. In known golf club heads having sole weight members, the weight member center of gravity is typically positioned within the club head. In known golf club heads having sole weight members wherein the weight member center of gravity is positioned outside the club head, the maximum projection height is significantly smaller than the maximum projection height 212 in the illustrated embodiment.

In the illustrated embodiment, referring to FIGS. 1-4, the weight member 70 and the crown surface curvature 84 together define a modified crown surface curvature or profile 85 (shown in FIG. 3) that has a non-linear profile or a bimodal profile or a bimodal slope that extends from the club face 22 to the back end 26 at a portion of the perimeter 74 defined by the crown 30. Generally, the slope of modified crown surface profile 85 decreases from the portion of the crown 30 in vertical alignment with the center of gravity 86 (FIG. 3) to the weight member 70, ceases decreasing or increases along a portion of the weight member 70, and then decreases to the back end 26 adjacent or at a portion of the perimeter 74. In other embodiments, the modified crown surface profile 85 may vary differently than the modified crown surface profile 85 described herein. For example, the modified crown surface profile 85 may be linear, quadratic, exponential, or a combination of the above described modified crown surface profiles 85.

In the illustrated embodiment, referring to FIGS. 1-4, the weight member 70 is positioned adjacent to the exterior side 78 of the crown 30 and projects above or from or extends above the crown surface curvature 84. In other embodiments, the weight member 70 may be positioned adjacent to the interior side 82 of the crown 30 and project below or extend below the crown surface curvature 84.

In the illustrated embodiment, referring to FIGS. 1-4, the weight member 70 is a continuous portion or band that extends adjacent to, near, or along a portion of the perimeter 74 defined by the crown 30. In other embodiments, the weight member 70 may include a plurality of weights or weight members 70 that extend adjacent to, near, or along a portion of the perimeter 74 defined by the crown 30. Further, one or more weight members 70 may be positioned on the exterior side 78 of the crown 30, one or more weight members 70 may be positioned on the interior side 82 of the crown 30, or one or more weight members 70 may be positioned on the exterior side 78 and the interior side 82 of the crown 30.

In the illustrated embodiment, referring to FIGS. 1-4, the weight member 70 is positioned adjacent to the crown 30 such that the weight member 70 extends through quadrants defined on the back side 26 of the x-axis 500 extending between the toe and heel ends 14, 18. The weight member 70 is also intersected by the z-axis 520, such that the z-axis 520 bisects the weight member 70 at 6 o'clock. In other words, the weight member center of gravity 88 is positioned at the 6 o'clock position when viewed from a top view, as shown in FIG. 1. In other embodiments, the weight member 70 may be provided at any location in the quadrants defined on a side of the x-axis 500 toward the back 26 of the club head 10. Stated another way, the weight member 70 may be provided at any location within the 3 o'clock to 6 o'clock quadrant such that the weight member center of gravity 88 is positioned closer to the toe end 14 than to the heel end 18, and/or at any location within the 6 o'clock to 9 o'clock quadrant such that the weight member center of gravity 88 is positioned closer to the heel end 18 than to the toe end 14.

Figure 2:
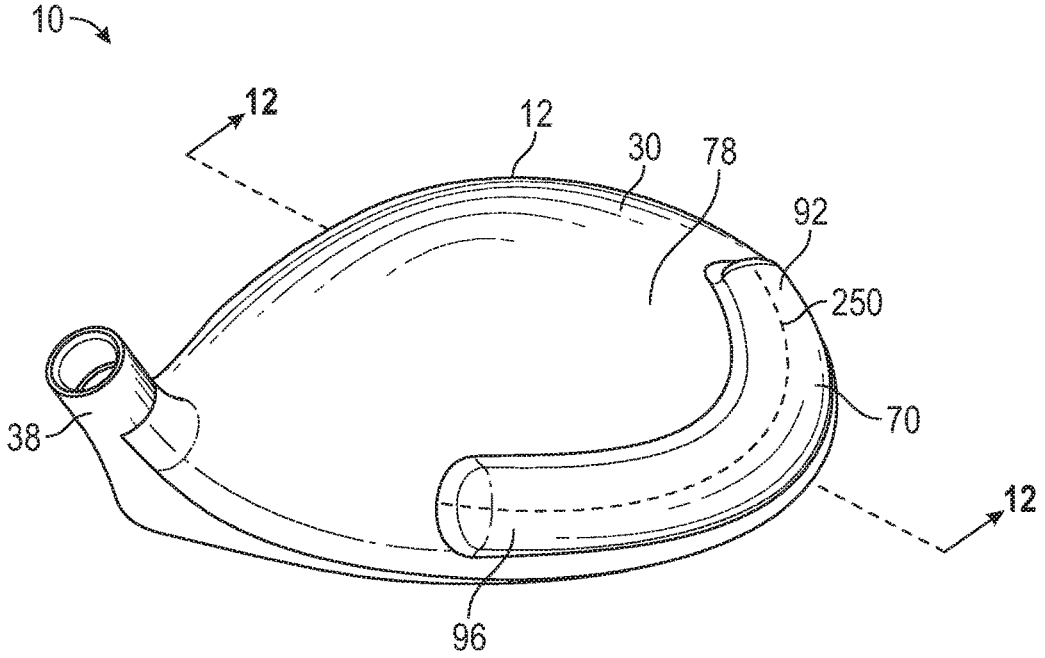
FIG. 2 is a perspective view of the golf club head in FIG. 1.
Figure 3:
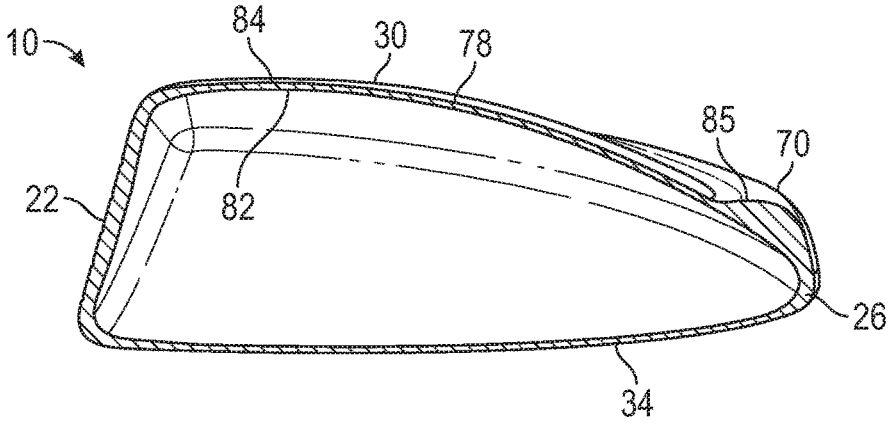
FIG. 3 is a side view of the club head in FIG. 1.

The illustrated embodiment, shown in FIGS. 1-2, depicts the weight member 70 positioned on the exterior side 78 of the crown 30 and extending about the crown 30 in an arcuate or curved manner, matching the curvature defined by the perimeter 74 of the crown 30. The weight member 70 is positioned on the crown 30 within the perimeter 74 as viewed in FIG. 1.

Referring to FIGS. 1-5, and in particular FIG. 5, the weight member center of gravity 88 is positioned at a perpendicular distance 220 from the crown 30. The weight member 70 includes a curved center line 250 extending through the weight member center of gravity 88, following the profile of the weight member 70 such that at any position along the perimeter 74 of the crown 30, the curved center line 250 is positioned at the perpendicular distance 220 from the crown 30.

In many embodiments, the weight member 70 further includes a length measured along the center line 250 extending from the first end 92 to the second end 96. In many embodiments, the length may range from 0.10-6.0 inches (2.54-152.4 mm). For example, the length may be between 2.5 inches (63.5 mm) and 5.5 inches (136.7 mm), or the length may be greater than approximately 0.10 inches (2.54 mm), greater than approximately 0.50 inches (12.7 mm), greater than approximately 1.0 inches (25.4 mm), greater than approximately 1.5 inches (38.1 mm), greater than approximately 2.0 inches (50.8 mm), or greater than approximately 2.5 inches (63.5 mm). For further example, the length can be approximately 2.5 inches (63.4 mm), 3.0 inches (76.2 mm), 3.5 inches (88.9 mm), 4.0 inches (101.6 mm), 4.5 inches (114.3 mm), or 5.0 inches (127 mm).

In the illustrated embodiment, the weight member 70 is positioned on the exterior side 78 of the crown 30 to maximize the distance from the weight member 70 to the head center of gravity 86. As depicted in FIGS. 4 and 5, the weight member 70 is positioned such that the curved center line 250 extends a first distance $D_1$ from the head center of gravity 86 in any particular position relative to the perimeter 74 of the club head 10. The distance $D_1$ may vary with position along the perimeter 74 of the club head 10. The first distance $D_1$ may be greater than any distance from the head center of gravity 86 to the interior side 82 or the exterior side 78 of the club head 10 on the crown 30 or sole 34 measured at the same particular position relative to the perimeter 74 of the club head 10. For example, FIG. 4 illustrates that the first distance $D_1$ is greater than both a second distance $D_2$, which extends from the head center of gravity 86 to the interior side 82 of the crown 30 of the club head 10, and a third distance $D_3$, which extends from the head center of gravity 86 to the interior side 82 of the sole 34 of the club head 10, wherein $D_1$, $D_2$, and $D_3$ are measured at approximately the 6 o'clock position along the perimeter 74. The same relationship may apply to the distances $D_1$, $D_2$, and $D_3$ when measured at any other position along the perimeter 74 of the club head 10, such as, for example, the 5 o'clock position or the 7 o'clock position.

The club head 10 may be made of any material such as titanium, steel, aluminum, other metals, metal alloys, composites, or any combination of materials. The weight member 70 may be made of the same material as the club head 10, or the weight member 70 may be made of a different material than the club head 10, such as titanium, steel, aluminum, other metals, metal alloys, composites, or any combination of materials. In embodiments where the weight member comprises a different material than the club head 10, the density of the weight member 70 can be greater than the density of the club head.

In some embodiments, the density of the weight member 70 can vary. Referring to FIG. 12, the weight member 70 can have one or more high density regions 90 (e.g. region(s) of the weight member 70 having greater density than the remaining regions of the weight member 70). For example, referring to FIG. 12*a*, the weight member can have a high density region 90 near the first end 92 to achieve a toe bias. For further example, referring to FIG. 12*b*, the weight member can have a high density region 90 near the second end 96 to achieve a heel bias. For further example, referring to FIG. 12*c*, the weight member 70 can have a high density region 90 near the center of the weight member 70. For further example, referring to FIG. 12*d*, the weight member 70 can have a plurality of high density regions 90 including a first high density region 90 near the first end 92 and a second high density region near the second end 96. In other embodiments, the density of the weight member 70 can be greater in any position, plurality of positions, or combination of positions along the weight member 70. Further, in other embodiments, the density of the weight member 70 can vary in discrete positions, or according to any profile. Further, in embodiments where the weight member includes one or more high density region(s) 90, the remaining regions of the weight member 70 can comprise a shell or have a void to reduce the mass of the weight member 70 outside the high density region(s) 90.

The weight member 70 has a mass or weight that can range from approximately 5 grams to approximately 150 grams, as described in further detail below. In embodiments where the weight member 70 includes one or more high density regions 90, the high density region(s) 90 comprises at least a portion of the mass of the weight member 70. In some embodiments, the high density region(s) 90 can comprise a majority of the mass of the weight member 70. For example, the high density region(s) 90 can comprise approximately 30%, approximately 35%, approximately 40%, approximately 45%, approximately 50%, approximately 60%, approximately 65%, approximately 70%, approximately 75%, approximately 80%, approximately 85%, approximately 90%, or approximately 95% of the mass of the weight member 70.

The weight member 70 has a mass or weight, wherein the weight of the weight member 70 may be a portion of the discretionary weight of the club head 10, or the weight of the weight member 70 may be the same as the discretionary weight of the club head 10. When the weight of the weight member 70 is a portion of the discretionary weight of the club head 10, the remaining discretionary weight may be positioned in areas of the club head 10 other than the crown 30, such as the sole 34, the face 22, the hosel 38, or a combination of the above listed positions.

Figures 6, 7:
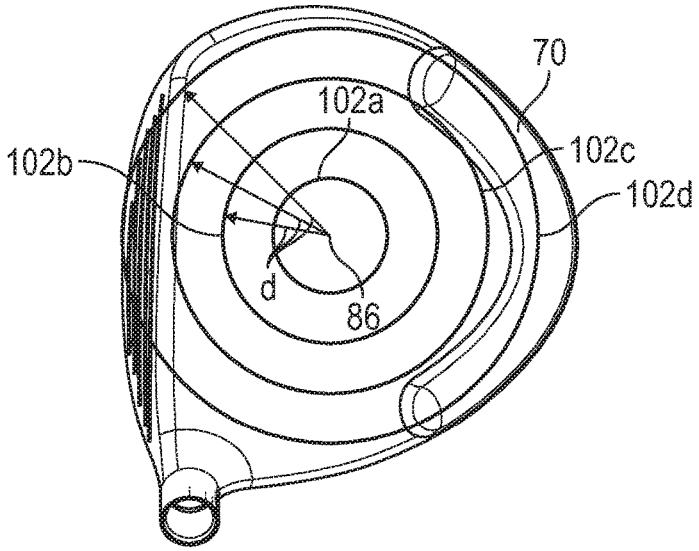
FIG. 6 is another top view of the club head of in FIG. 1.
FIG. 7 is a table providing data associated with exemplary club heads of the club head in FIG. 1 including drivers, fairway woods, and hybrids.

The amount of discretionary weight of the club head 10 varies with the type of club head 10. For example, the discretionary weight varies with total weight and length of the club head 10, and can range from 5 grams to 150 or more grams. FIG. 7 depicts a table with ranges of total weight of the club head 10, discretionary weight of the club head 10, discretionary weight as a percentage of total weight of the club head 10, and assembled golf club length for exemplary drivers, a fairway woods, and hybrids. For example, the discretionary weight may range from approximately 20-60 grams for a driver (approximately 15-35 percent of the total weight of the driver-type club head 10), the discretionary weight may range from approximately 45-85 grams for a fairway wood (approximately 20-40 percent of the total weight of the wood-type club head 10), and the discretionary weight may range from approximately 70-130 grams for a hybrid (approximately 25-55 percent of the total weight of the hybrid-type club head 10). Generally, discretionary weight, measured as a percentage of total weight of the club head 10, increases as the weight of the club head 10 increases and as the length of the club head 10 decreases.

Figure 9:
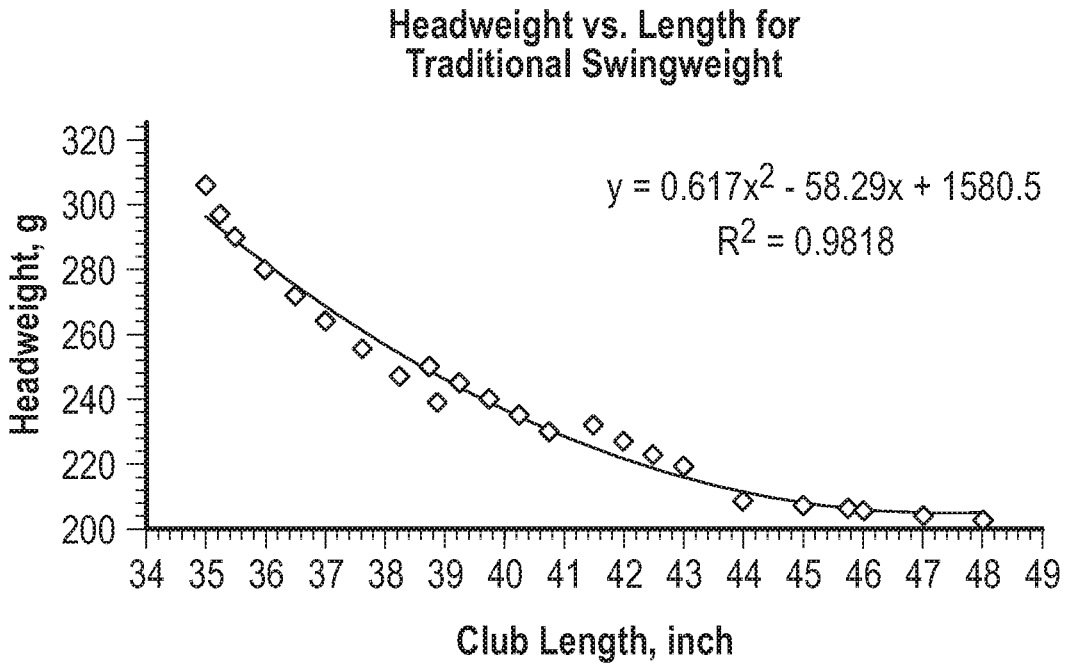
FIG. 9 is a graphical illustration of certain data presented in FIG. 8.

FIGS. 8-9 depict the interdependent relationship between discretionary weight, length of the golf club, swing weight, and total weight of the club head 10 through an exemplary set of golf clubs including drivers, fairway woods, hybrids, and irons. As illustrated in FIG. 8, the amount of discretionary weight, listed as discretionary mass, varies as swing weight ("SWT," which generally is assigned a value from A0 (lightest) to F9 (heaviest), e.g. D0-D6) of the golf club, the length of the golf club (or "club length" measured in inches), and weight of the club head 10 (measured in grams) vary. It should be appreciated that the disclosed club lengths, head weights, swing weights, and discretionary weights are provided for purposes of illustration, and may include a range or band of club lengths, head weights, swing weights, and/or discretionary weights above and below the disclosed data points of FIGS. 8-9.

Generally, club heads 10 are lighter in longer clubs to preserve swing weight in a range that does not hinder a golf swing. When the golf club has a swing weight that is too light, the performance of the club is reduced due to lower MOI of the club head and poor head center of gravity 86 placement. When the golf club has a swing weight that is too high, the club can be difficult to swing and deliver at impact.

Referring to FIG. 8, discretionary weight is provided for a group of example drivers having the same target swing weight of D3, but different club lengths from 44 inches (112 cm) to 48 inches (122 cm), and corresponding different head weights from 202.5 grams (for the longest, 48 inch (122 cm) long driver) to 208.5 grams (for the shortest, 44 inch (112 cm) long driver). The discretionary weight ranges from greater than or equal to 39.5 grams, or approximately 19.5% of the total head weight (for the longest, 48 inch (122 cm) long driver) to greater than or equal to 45.5 grams, or approximately 21.8% of the total head weight (for the shortest, 44 inch (112 cm) long driver). While the drivers described herein are exemplary drivers, the same relationship may apply to drivers having a volume greater than or equal to approximately 400 cc, lofts between approximately 5-16 degrees, and club lengths greater than or equal to approximately 43 inches. Further, other exemplary drivers may have volumes ranging from 400 cc-470 cc (including 400, 405, 410, 415, 420, 425, 430, 435, 440, 445, 450, 455, 460, 465, or 470 cc), lofts ranging from 0-20 degrees (including 0, 1, 2, 3, 4, 5, 6, 7, 8, 9, 9.5, 10, 10.5, 11, 11.5, 12, 12.5, 13, 13.5, 14, 14.5, 15, 15.5, 16, 16.5, 17, 17.5, 18, 18.5, 19, 19.5, or 20 degrees), and club lengths greater than or equal to 30 inches (76 cm), 31 inches (79 cm), 32 inches (81 cm), 33 inches (84 cm), 34 inches (86 cm), 35 inches (89 cm), 36 inches (91 cm), 37 inches (94 cm), 38 inches (97 cm), 39 inches (99 cm), 40 inches (102 cm), 41 inches (104 cm), 42 inches (107 cm), 43 inches (109 cm), 44 inches (112 cm), 45 inches (114 cm), 46 inches (117 cm), 47 inches (119 cm), 48 inches (122 cm), 49 inches (124 cm), or 50 inches (127 cm).

Further referring to FIG. 8, discretionary weight is also provided for a group of example fairway woods having the same target swing weight of D1, but different club lengths from 43 inches (for a lower lofted 3-wood) to 41.5 inches (for a higher lofted 9-wood), and corresponding different head weights from 219 grams (for the 3-wood) to 232 grams (for the 9-wood). The discretionary weight ranges from greater than or equal to 59 grams, or approximately 26.9% of the total head weight (for the 3-wood) to greater than or equal to 72 grams, or approximately 31.0% of the total head weight (for the 9-wood). While the fairway woods described herein are exemplary fairway woods, the same relationship may apply to any fairway woods having a volume between approximately 115-300 cc, lofts between approximately 10-40 degrees, and club lengths between approximately 38-44 inches (97-112 cm).

Further referring to FIG. 8, discretionary weight is also provided for a group of example hybrids having the same target swing weight of D1, but different club lengths from 40.75 inches (103.5 cm) (for a lower lofted 2-hybrid) to 38.75 inches (98.4 cm) (for a higher lofted 6-hybrid), and corresponding different head weights from greater than or equal to 230 grams (for the 2-hybrid) to greater than or equal to 250 grams (for the 6-hybrid). The discretionary weight ranges from 90 grams, or approximately 39.1% of the total head weight (for the 2-hybrid) to 110 grams, or approximately 44.0% of the total head weight (for the 6-hybrid). While the hybrids described herein are exemplary hybrids, the same relationship may apply to any hybrid having a volume between approximately 80-140 cc, lofts between approximately 15-60 degrees, and club lengths between approximately 35-42 inches (89-107 cm).

Further referring to FIG. 8, discretionary weight is also provided for a group of example irons having the same target swing weight of D0, but different club lengths from 38.875 inches (98.7 cm) (for a lower lofted 4-iron) to 35 inches (88.69 cm) (for a higher lofted wedge), and corresponding different head weights from 239 grams (for the 4-iron) to 306 grams (for the wedge). The discretionary weight ranges from greater than or equal to 24 grams, or approximately 10.1% of the total head weight (for the 4-iron) to greater than or equal to 43 grams, or approximately 14.1% of the total head weight (for the wedge). While the irons described herein are exemplary irons, the same relationship may apply to any iron having lofts between approximately 15-60 degrees, and club lengths between approximately 35-42 inches (88.9-107 cm).

FIG. 9 graphically depicts an exemplary relationship of club length (in inches) to total weight of the club head 10 (in grams) for a traditional target swing weight. By graphically depicting the data in FIG. 8, the interdependent relationship of head weight, club length, and swing weight (and in turn discretionary weight) for the exemplary golf clubs described herein is illustrated, as evidence by the high correlation of the data points to the coefficient of determination, which is denoted by an R squared value of 0.9818.

The weight member 70, described herein, affects the head center of gravity 86 position and the MOI of the club head 10 about the y-axis 510, the x-axis 500, and/or the hosel axis 36. Changing the head center of gravity 86 and the moment of inertia of the club head 10 about the y-axis 510, the x-axis 500, and/or the hosel axis 36 by positioning of the weight member 70 may change the performance characteristics of the golf club during a swing, at impact with a golf ball, or a combination of both (i.e. during a swing and at impact with the golf ball).

During a swing, the club head 10 rotates about the hosel axis 36 to square the face 22 at impact with the golf ball. Squaring the face 22 during a swing promotes the desired ball direction. At impact, the position of contact with the golf ball on the club face 22, relative to the head center of gravity 86 position, affects the spin of the golf ball, or the gear effect. During flight, the golf ball spins or rotates about an axis. The axis of rotation of the golf ball can be broken down into components including a vertical axis perpendicular to a ground plane, and a horizontal axis parallel to a ground plane. The component of spin of the golf ball about the vertical axis affects ball direction. The component of spin of the golf ball about the horizontal axis affects trajectory and distance. The gear affect is described in further detail in the example below.

For example, impact of the golf ball on the club face 22, offset from the head center of gravity 86 in the direction of the x-axis 500, causes the club head 10 to rotate about the y-axis 510 in a first direction, thereby imparting a component of spin on the golf ball about the vertical axis in a second direction opposite the first direction. The component of spin of the golf ball about the vertical axis affects the fade or draw of the golf ball. Similarly, impact of the golf ball on the face 22, offset from the head center of gravity 86 in the direction of the y-axis 510, causes the club head 10 to rotate about the x-axis 500 in a third direction, thereby imparting a component of spin on the golf ball about the horizontal axis in a fourth direction opposite the third direction. The component of spin of the golf ball about the horizontal axis affects the trajectory and distance of the golf ball.

Typically, in golf club design, increased MOI of the club head 10 about the x-axis 500 and the y-axis 510 is desired. Increasing the MOI of the club head 10 about the x-axis 500 and/or the y-axis 510 results in increased resistance to rotation of the club head 10 about the x-axis 500 and/or the y-axis 510, respectively, leading to reduced rotation of the club head and golf ball due to off center hits at impact. Increasing the MOI of the club head 10 about the x-axis 500 reduces the component of horizontal spin of the golf ball due to off center impact, thereby increasing forgiveness and consistency in ball trajectory and distance. Increasing the MOI of the club head 10 about the y-axis 500 reduces the component of vertical spin of the golf ball due to off center impact, thereby increasing forgiveness and consistency in ball direction. MOI of the club head 10 about an axis may be increased or maximized by increasing or maximizing the perpendicular distance between the weight member center of gravity 86 and the axis.

In the illustrated embodiment, shown in FIG. 4, the weight member 70 is positioned on the exterior side 78 of the crown 30 such that the distance between the weight member center of gravity 88 and the head center of gravity 86 is increased or maximized compared to a known club head with a weight member positioned closer to the head center of gravity. Specifically, the perpendicular distance between the weight member center of gravity 88 and the y-axis 510 (and therefore the MOI of the club head 10 about the y-axis 510) is increased or maximized, and the perpendicular distance between the weight member center of gravity 88 and the x-axis 500 (and therefore the MOI of the club head 10 about the x-axis 500) is increased or maximized compared to a known club head having a weight member positioned closer to the head center of gravity. Therefore, the club head 10 having the weight member 70 has increased or maximized directional forgiveness and consistency (due to the increased MOI of the club head about the y-axis) and increased or maximized consistency in trajectory and distance of the golf ball (due to the increased MOI of the club head about the x-axis).

The position of the weight member 70 on the club head 10 may also be used affect the MOI of the club head 10 about the hosel axis 36. For example, the weight member center of gravity 88 may be positioned closer to the heel 18 or closer to the toe 14 of the club head 10 to create a heel or toe bias.

Positioning the weight member 70 such that the weight member center of gravity 88 is closer to the heel 18 than to the toe 14 (i.e. between the 6 o'clock and 9 o'clock positions) will shift the head center of gravity 86 toward the heel 18 and decrease the perpendicular distance from the head center of gravity 86 to the hosel axis 36, thereby reducing the MOI of the club head 10 about the hosel axis 36. Therefore, the club head 10 would have less resistance to rotation about the hosel axis 36 during a swing, allowing the user to more easily square the face 22 at impact to correct the tendency of a user to impact the golf ball with an open face 22. Conversely, positioning the weight member 70 such that the weight member center of gravity 88 is closer to the toe 14 than to the heel 18 (i.e. between the 3 o'clock and 6 o'clock positions) will shift the head center of gravity 86 toward the toe 14 and increase the perpendicular distance from the weight member center of gravity 86 to the hosel axis 36, thereby increasing the MOI of the club head 10 about the hosel axis 36. Therefore, the club head 10 would have greater resistance to rotation about the hosel axis 36 during a swing to correct the tendency of a user to impact the golf ball with a closed face 22.

Referring to FIG. 6, a proof of concept test was performed to demonstrate the increased MOI of the club head 10 having the weight member 70 about the y-axis 510, leading to increased forgiveness of the club head 10. The proof of concept demonstrates that the MOI of the club head 10 about the y-axis 510 increases as the weight member 70 position and/or position of the discretionary weight is moved away from the head center of gravity 86 of the club head 10. To demonstrate this conclusion, discretionary weight was moved and repositioned in the form of weight members 70 at increasing distances d away from the head center of gravity 86 along concentric circles or bands 102*a-d*. The MOI of the club head 10 about the y-axis 510 was calculated with no repositioning of discretionary weight on the crown 30 of the club head (a baseline). Then, the MOI of the club head 10 about the y-axis 510 was separately calculated for discretionary weight repositioned in the form of weight members 70 along bands 102*a*, 102*b*, 102*c*, and 102*d*, respectively. The MOI of the club head 10 about the y-axis 510 was significantly greater (up to approximately 50% greater) when discretionary weight was repositioned in the form of the weight member 70 along band 102*d* than when discretionary weight was not repositioned at all (the baseline, i.e. without the weight member 70).

Figure 13:
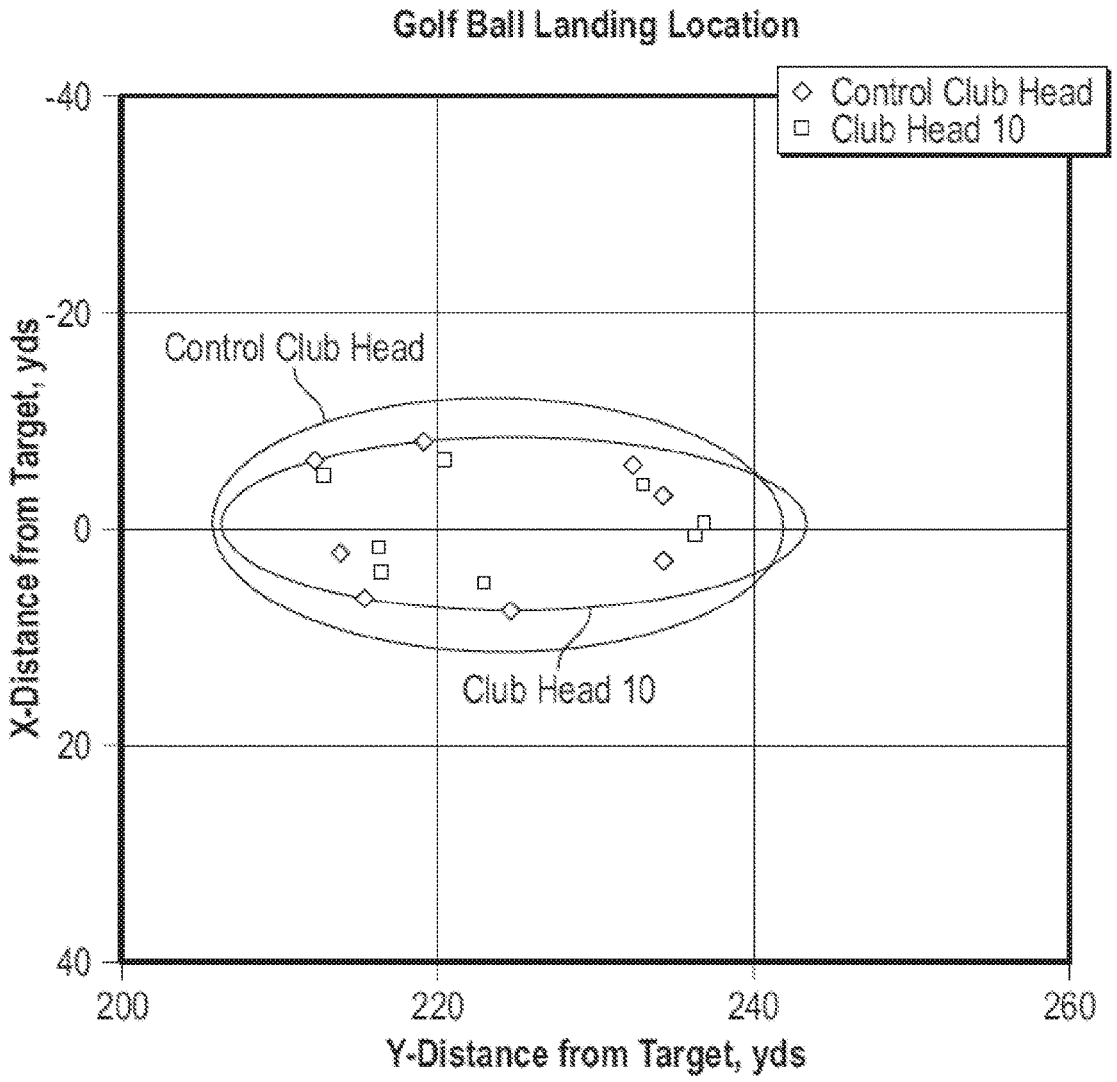
FIG. 13 illustrates test results of the club head in FIG. 1.

Referring to FIG. 13, the club head 10 having the weight member 70 demonstrated reduced scatter in golf ball landing location (as indicated by the elliptical trend lines), compared to a similar control club head without the weight member. The results illustrated in FIG. 13 utilized exemplary fairway-wood type golf clubs with controlled swing conditions (e.g. swing speed and orientation). Reduced scatter in golf ball landing location of the club head 10 having the weight member 70 is a result of the increased MOI of the club head 10.

In the illustrated embodiment, the position of the weight member 70 on the exterior side 78 of the crown 30 may result in aerodynamic benefits of the club head. For example, the position of the weight member 70 on the exterior side 78 of the crown 30 may result in reduced aerodynamic drag and therefore increased club head 10 speed. Increased club head 10 speed may result in greater golf ball travel distance.

In the illustrated embodiment, the weight member 70 is positioned on the exterior side 78 of the crown 30, therefore the head center of gravity 86 is positioned closer to the crown 30 and the back 26 of the club head 10 than the head center of gravity 86 of the club head 10 without the weight member 70. The shift in head center of gravity 86 toward the crown 30 of the club head 10 may impart additional, undesired backspin on the golf ball at impact, which can lead to a decrease in golf ball travel distance. In order to counteract the described effects, other known methods of reducing backspin on the golf ball at impact may be implemented. For example, reducing backspin on the golf ball may be accomplished by increasing surface roughness on the club face 22. Generally, the additional forgiveness and consistency in direction and distance of the golf ball, resulting from the increased MOI of the club head 10 about the x-axis 500 and y-axis 510, outweigh the undesired effects from the head center of gravity 86 position relative to the crown 30 of the club head 10.

In the illustrated embodiment, the position of the weight member 70 on the exterior side 78 of the crown 30 may require balancing of additional discretionary weight or non-discretionary weight in alternative positions. For example, the internal or external structure of the club head 10 may be adjusted to balance the position of the weight member 70 on the exterior side 78 of the crown 30 by adding internal or external geometries, altering the material or geometry of the body 12 of the club head 10, altering the material or geometry of the club face 22, or any combination of the described alterations.

Figure 11:
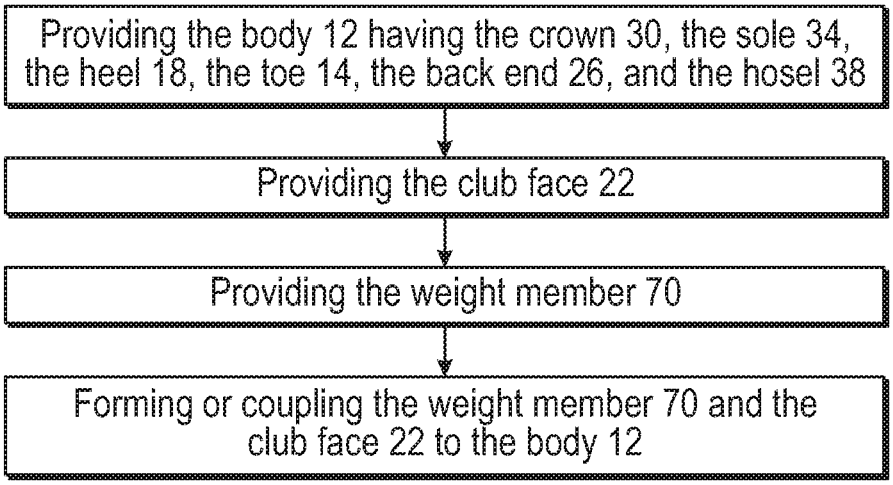
FIG. 11 is a method of manufacturing the golf club head in FIG. 1
Figure 12A:
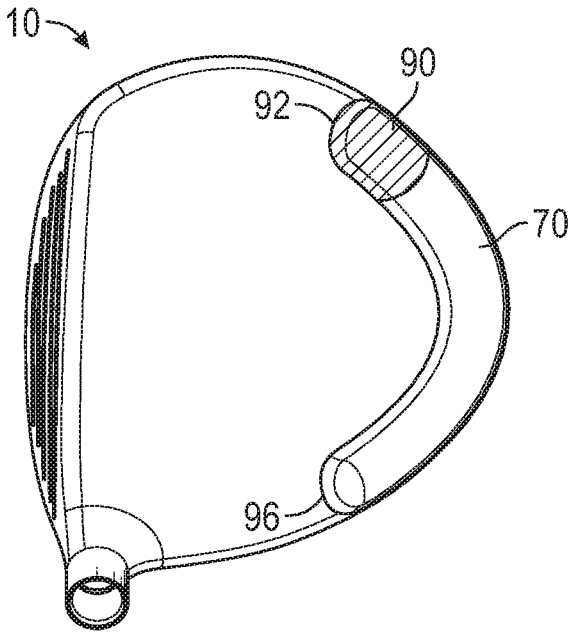
FIG. 12A illustrates an embodiment of the club head in FIG. 1 having a high density region near the first end of the weight member to achieve a toe bias.
Figure 12B:
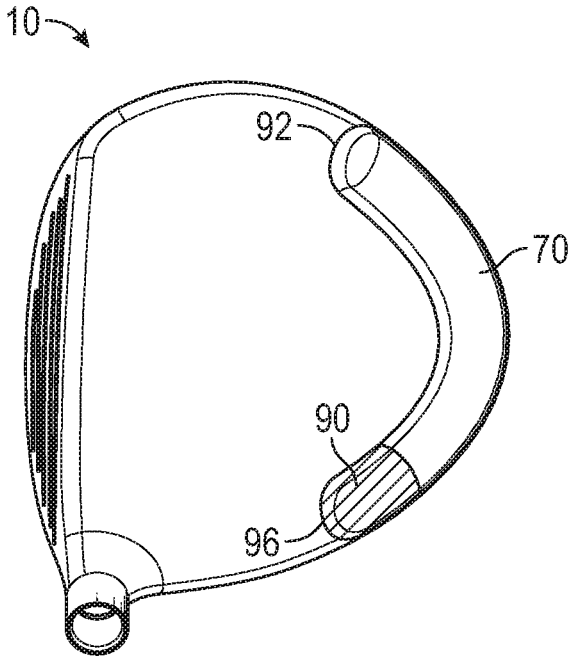
FIG. 12B illustrates an embodiment of the club head in FIG. 1 having a high density region near the second end of the weight member to achieve a heel bias.
Figure 12C:
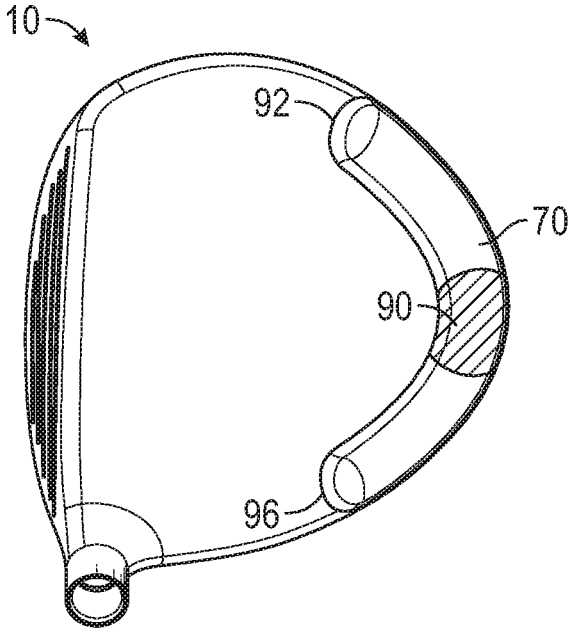
FIG. 12C illustrates an embodiment of the club head in FIG. 1 having a high density region near the center of the weight member.
Figure 12D:
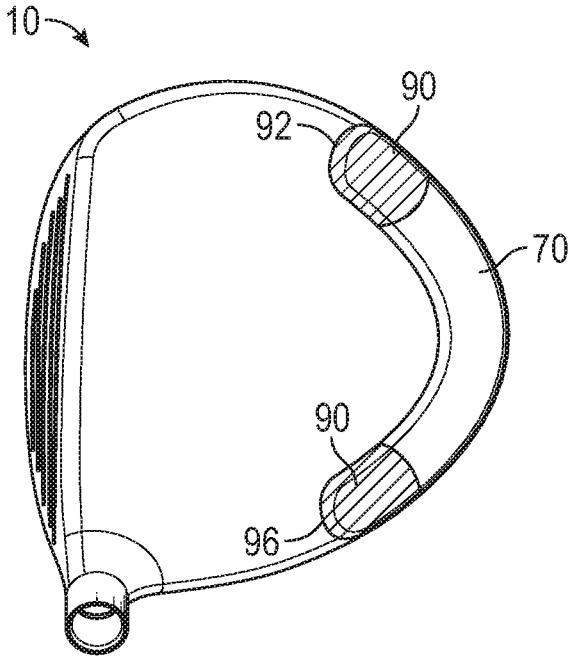
FIG. 12D illustrates an embodiment of the club head in FIG. 1 having high density regions near both the first and second ends of the weight member.

FIG. 11 illustrates a method of manufacturing the club head 10 having the weight member 70. The method includes providing the body 12 having the crown 30, the sole 34, the heel 18, the toe 14, the back end 26, and the hosel 38, providing the club face 22, providing the weight member 70, and forming or coupling the weight member 70 and the club face 22 to the club body 12. In some embodiments, providing the body 12 includes casting or machining the body 12. In other embodiments, the body 12 can be formed using any other suitable method, such as machining or 3D printing. In some embodiments, providing the club face 22 includes machining the club face 22. In other embodiments, the club face 22 can be formed using any other suitable method, such as casting or 3D printing. In some embodiments, providing the weight member 70 can include casting, machining, 3D printing, or any other suitable method to form the weight member 70.

The method of manufacturing the club head 10 described herein is merely exemplary and is not limited to the embodiments presented herein. The method can be employed in many different embodiments or examples not specifically depicted or described herein. In some embodiments, the processes of the method described can be performed in any suitable order. In other embodiments, one or more of the processes may be combined, separated, or skipped.

The weight member 70 may be formed at the same time as the body 12 during casting or the weight member 70 may be formed separately and coupled to the body 12 of the club head 10. When the weight member 70 is be formed at the same time as the body 12 during casting, the added weight provided on the exterior side 78 of the crown 30 may increase the flow rate of molten material during the casting process to form the club head 10 having the weight member 70.

Figure 10:
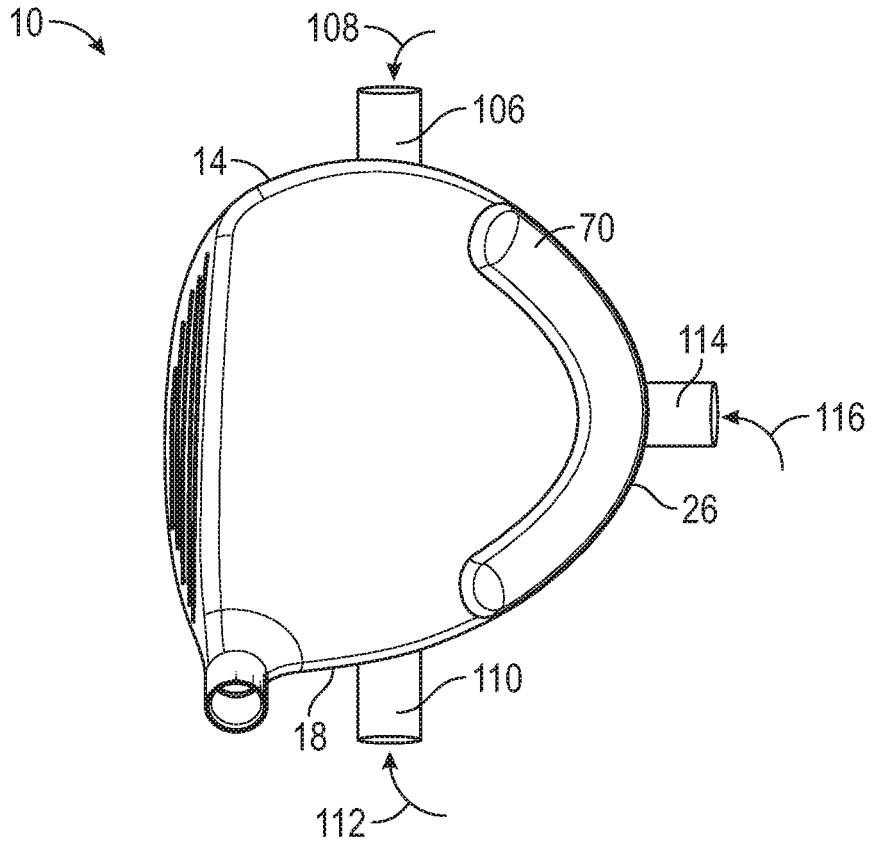
FIG. 10 is another top view of the club head in FIG. 1.

As illustrated in FIG. 10, the club head 10 includes a first port or gate 106 at the toe side 14, a second port or gate 110 at the heel side 18, and a third port or gate 114 at the rear of the club head 10. Each gate 106, 110, 114 allows for the introduction of molten material into the mold during casting to integrally form the weight member 70 to the crown 30. The molten material flow direction is illustrated by arrows 108, 112, and 116. The position of the weight member 70 on the crown 30 near the third gate 114 results in an increase in flow rate of the molten material through the casting mold due to the increased size in cross sectional area of the third gate 114 opening required to accommodate weight member 70. The increase in molten material flow rate and/or the ability of the molten material to move more freely, assists the molten material in flowing to the crown 30, the sole 34, the heel 18, and/or the toe 14 to reach relatively thin sections of the casting mold and to carry slag and/or particulates out of the club body 12. It should be appreciated that in other embodiments, the weight member 70 may be attached or otherwise secured to the crown 30 as a separate component after casting of the crown 30. Further, the weight member 70 may be formed at the same time as the body 12 using processes other than casting, such as, for example, metal injection molding (MIM), separate cast, forging, machining, printing, or rapid prototyping.

Clause 1: A golf club head comprising: a body having a crown defining a perimeter of the club head, a sole opposite the crown, a toe end opposite a heel end, a back end, and a hosel; a club face; an exterior side; an interior side; a head center of gravity; and a weight member positioned on one of the exterior side or the interior side of the crown, the weight member having a weight member center of gravity and an elongated arcuate shape along the crown.

Clause 2: The golf club head of clause 2, wherein the weight member is positioned on a side of an x-axis toward the back end, wherein the x-axis extends through the head center of gravity from the toe end to the heel end.

Clause 3: The golf club head of clause 1, wherein the weight member further includes at least one of (a) a width between approximately 0.25 and 1.5 inches, (b) a projection height between approximately 0.05 and 0.45 inches, (c) a length between approximately 2.5 and 5.5 inches, or (d) any combination thereof.

Clause 4: The golf club head of clause 1, wherein the weight member includes a plurality of weight members.

Clause 5: The golf club head of clause 4, wherein each weight member of the plurality of weight members extends along a portion of the perimeter defined by the crown.

Clause 6: The golf club head of clause 4, wherein the plurality of weight members includes at least one weight member positioned on the exterior side of the club head and at least one weight member positioned on the interior side of the club head.

Clause 7: The golf club head of clause 1, wherein the crown defines a crown surface curvature that extends from the club face to the back end, the weight member projecting from the crown surface curvature.

Clause 8: The golf club head of clause 1, wherein the crown and the weight member define a crown surface curvature having a bi-modal profile that extends from the club face to the back end.

Clause 9: The golf club head clause 1, wherein the crown and the weight member define a crown surface curvature having a bi-modal profile that extends from the club face to the back end at a portion of the perimeter defined by the crown.

Clause 10: The golf club head of clause 1, wherein the weight member is formed of discretionary weight.

Clause 11: The golf club head of clause 1, wherein the club head is a driver-type club head, a wood-type club head, or a hybrid-type club head.

Clause 12: The golf club head of clause 1, wherein the weight member has a weight ranging from approximately 15% to 55% of a total weight of the golf club head.

Clause 13: The golf club head of clause 11, wherein the weight member has a weight ranging from 15% to 35% of a total weight of the driver-type club head.

Clause 14: The golf club head of clause 11, wherein the weight member has a weight ranging from approximately 20% to 40% of a total weight of the wood-type club head.

Clause 15: The golf club head of clause 11, wherein the weight member has a weight ranging from approximately 25% to 55% of a total weight of the hybrid-type club head.

Clause 16: The golf club head of clause 1, wherein the weight member has a weight ranging from 20 grams to 130 grams.

Clause 17: The golf club head of clause 11, wherein the weight member has a weight ranging from 20 grams to 60 grams for the driver-type club head.

Clause 18: The golf club head of clause 11, wherein the weight member has a weight ranging from 45 grams to 85 grams for the wood-type club head.

Clause 19: The golf club head of clause 11, wherein the weight member has a weight ranging from 70 grams to 130 grams for the hybrid-type club head.

Clause 20: A golf club head comprising: a body having a crown defining a perimeter of the club head, a sole opposite the crown, a toe end opposite a heel end, a back end, and a hosel; a club face; an exterior side; an interior side; a head center of gravity; and a weight member positioned on one of the exterior side or the interior side of the crown, the weight member having a weight member center of gravity and a curved center line extending through the weight member center of gravity such that at any position along the perimeter, the curved center line is positioned at the same perpendicular distance from the crown; wherein a first distance from the head center of gravity to the curved center line at a particular position relative to the perimeter is greater than any second distance from the head center of gravity to the interior side or the exterior side of the club head on the crown or sole at the particular position relative to the perimeter.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a wood-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A golf club head comprising:

a golf club head body having a crown defining a perimeter of the club head, a sole opposite the crown, a toe end opposite a heel end, a back end, and a hosel;

a club face;

an exterior side;

an interior side;

a head center of gravity; and a weight member permanently positioned adjacent the exterior side of the crown, the weight member having a weight member center of gravity and an elongated arcuate shape along the crown;

wherein the weight member is positioned about a portion of a perimeter of the exterior side of the crown, wherein the weight member is positioned to maximize the distance from the weight member to the head center of gravity, wherein a first end of the weight member is positioned at a toe end of the crown and a second end is positioned at a heel end of the crown, wherein a length of the weight member is measured along a center line of the weight member extending from the first end to the second end, wherein the length of the weight member is in a range between 2.5 inches to 6.0 inches, wherein the weight member is solid in a cross section at any point, wherein the weight member is composed of the same material as the golf club head body, wherein the weight member is integrally cast with the golf club head body, wherein the weight member has a weight ranging from 35 grams to 130 grams.

2. The golf club head of claim 1, wherein the weight member is positioned on a side of an x-axis toward the back end, wherein the x-axis extends through the head center of gravity from the toe end to the heel end.

3. The golf club head of claim 1, wherein the weight member further includes at least one of (a) a width between approximately 0.25 and 1.5 inches, (b) a projection height between approximately 0.05 and 0.45 inches, (c) a length between approximately 2.5 and 5.5 inches, or (d) any combination thereof.

4. The golf club head of claim 1, wherein the weight member includes a plurality of weight members.

5. The golf club head of claim 4, wherein each weight member of the plurality of weight members extends along a portion of the perimeter defined by the crown.

6. The golf club head of claim 1, wherein the crown defines a crown surface curvature that extends from the club face to the back end, the weight member projecting from the crown surface curvature.

7. The golf club head of claim 1, wherein the crown and the weight member define a crown surface curvature having a bi-modal profile that extends from the club face to the back end.

8. The golf club head of claim 1, wherein the crown and the weight member define a crown surface curvature having a bi-modal profile that extends from the club face to the back end at a portion of the perimeter defined by the crown.

9. The golf club head of claim 1, wherein the weight member is formed of discretionary weight.

10. The golf club head of claim 1, wherein the club head is a driver-type club head, a wood-type club head, or a hybrid-type club head.

11. The golf club head of claim 10, wherein the weight member has a weight ranging from 15% to 35% of a total weight of the driver-type club head.

12. The golf club head of claim 10, wherein the weight member has a weight ranging from approximately 20% to 40% of a total weight of the wood-type club head.

13. The golf club head of claim 10, wherein the weight member has a weight ranging from approximately 25% to 55% of a total weight of the hybrid-type club head.

14. The golf club head of claim 10, wherein the weight member has a weight ranging from 35 grams to 60 grams for the driver-type club head.

15. The golf club head of claim 10, wherein the weight member has a weight ranging from 45 grams to 85 grams for the wood-type club head.

16. The golf club head of claim 10, wherein the weight member has a weight ranging from 70 grams to 130 grams for the hybrid-type club head.

17. The golf club head of claim 1, wherein the weight member has a weight ranging from approximately 15% to 55% of a total weight of the golf club head.

18. A golf club head comprising:

a golf club head body having a crown defining a perimeter of the club head, a sole opposite the crown,
a toe end opposite a heel end,
a back end, and
a hosel;
a club face; an exterior side;
an interior side;
a head center of gravity; and
a weight member permanently positioned adjacent the exterior side of the crown,
wherein the weight member is positioned about a portion of a perimeter of the exterior side of the crown,
wherein the weight member is positioned to maximize the distance from the weight member to the head center of gravity,
wherein a first end of the weight member is positioned at a toe end of the crown and a second end is positioned at a heel end of the crown,
wherein a length of the weight member is measured along a center line of the weight member extending from the first end to the second end,
wherein the length of the weight member is in a range between 2.5 inches to 6.0 inches,
wherein the weight member is solid in a cross section at any point,
wherein the weight member is composed of the same material as the golf club head body,
wherein the weight member is integrally cast with the golf club head body,
wherein the weight member has a weight ranging from 35 grams to 130 grams,
the weight member having a weight member center of gravity and a curved center line extending through the weight member center of gravity such that at any position along the perimeter,
the curved center line is positioned at the same perpendicular distance from the crown;
wherein a first distance from the head center of gravity to the curved center line at a particular position relative to the perimeter is greater than any second distance from the head center of gravity to the interior side or the exterior side of the club head on the crown or sole at the particular position relative to the perimeter.

19. A golf club head comprising:
a golf club head body having a crown defining a perimeter of the club head and a crown surface curvature,
a sole opposite the crown,
a toe end opposite a heel end,
a back end, and
a hosel;
a club face;
an exterior side;
an interior side;
a head center of gravity; and
a weight member positioned adjacent to the exterior side of the crown and projecting above the crown surface curvature,
the weight member having a weight member center of gravity and an elongated arcuate shape along the crown;
wherein the weight member is positioned about a portion of a perimeter of the exterior side of the crown,
wherein the weight member is positioned to maximize the distance from the weight member to the head center of gravity,
wherein a first end of the weight member is positioned at a toe end of the crown and a second end is positioned at a heel end of the crown,
wherein a length of the weight member is measured along a center line of the weight member extending from the first end to the second end,
wherein the length of the weight member is in a range between 2.5 inches to 6.0 inches,
wherein the weight member is solid in a cross section at any point,
wherein the weight member is composed of the same material as the golf club head body,
wherein the weight member is integrally cast with the golf club head body,
wherein the weight member has a weight ranging from 35 grams to 130 grams.

* * * * *